US011118604B2

(12) United States Patent
Chandra Tripathi et al.

(10) Patent No.: US 11,118,604 B2
(45) Date of Patent: Sep. 14, 2021

(54) HYDRAULIC SYSTEM FOR HYDRO-MECHANICAL MACHINES COMPRISING ROTARY MECHANISM

(71) Applicant: L&T TECHNOLOGY SERVICES LIMITED, Tamil Nadu (IN)

(72) Inventors: Atul Chandra Tripathi, Noida (IN); Shailendra J Shrivastava, Bengaluru (IN)

(73) Assignee: L&T TECHNOLOGY SERVICES LIMITED, Chennai (IN)

( * ) Notice: Subject to any disclaimer, the term of this patent is extended or adjusted under 35 U.S.C. 154(b) by 0 days.

(21) Appl. No.: 16/619,590

(22) PCT Filed: Nov. 9, 2018

(86) PCT No.: PCT/IB2018/058806

§ 371 (c)(1),
(2) Date: Dec. 5, 2019

(87) PCT Pub. No.: WO2019/239208

PCT Pub. Date: Dec. 19, 2019

(65) Prior Publication Data

US 2021/0018019 A1 Jan. 21, 2021

(30) Foreign Application Priority Data

Jun. 11, 2018 (IN) ..... 201841021688

(51) Int. Cl.
*F15B 1/02* (2006.01)

(52) U.S. Cl.
CPC ..... *F15B 1/024* (2013.01); *F15B 2201/51* (2013.01)

(58) Field of Classification Search
CPC ..... F15B 1/024
See application file for complete search history.

(56) References Cited

U.S. PATENT DOCUMENTS

| | | | | |
|---|---|---|---|---|
| 9,290,912 | B2 * | 3/2016 | Wen | F15B 13/06 |
| 9,556,591 | B2 * | 1/2017 | Shang | F15B 1/02 |
| 2015/0101164 | A1 | 4/2015 | Ma et al. | |
| 2015/0225928 | A1 * | 8/2015 | Wu | F15B 21/14 60/413 |

* cited by examiner

*Primary Examiner* — F Daniel Lopez
(74) *Attorney, Agent, or Firm* — Maschoff Brennan

(57) ABSTRACT

This disclosure relates to a hydraulic system for a hydro-mechanical machine comprising a rotary mechanism. The hydraulic system includes a primary accumulator configured to receive and store high-pressure fluid in response to stopping of the rotary mechanism. A control system coupled to the primary accumulator through a hydraulic supply circuit is configured to enable passage of the high-pressure fluid stored in the primary accumulator to a rotary control valve configured to control the rotary mechanism, through the hydraulic supply circuit, based on a predefined pressure threshold associated with the primary accumulator. A secondary accumulator coupled to the primary accumulator and the control system via the hydraulic supply circuit is configured to store surplus high-pressure fluid provided by the primary accumulator through the hydraulic supply circuit.

20 Claims, 6 Drawing Sheets

HYDRAULIC SYSTEM FOR HYDRO-MECHANICAL MACHINES COMPRISING ROTARY MECHANISM

TECHNICAL FIELD

This disclosure relates generally to hydro-mechanical machines, and more particularly to hydraulic system for hydro-mechanical machines comprising rotary mechanism.

BACKGROUND

Hydro-mechanical machines, especially construction machines, such as, excavators use multiple hydraulic actuators to accomplish a variety of tasks. The actuators are fluidly connected to a pump that provides pressurized fluid to operate the actuators and a work tool that is further connected to the actuators. Once hydraulic energy of the pressurised fluid is utilized, pressurized fluid is returned to a low-pressure reservoir. Usually the fluid being drained is at a higher pressure, when compared with the pressure in the low-pressure reservoir. Thus, the remaining energy in the fluid is wasted once it enters the low-pressure reservoir. This wasted energy reduces the efficiency of the entire hydro-mechanical machine over a course of machine duty cycle. By way of an example, in an excavator, energy loss is caused due to a swing drive, where the fluid at high pressure is relived through a cross port relief valve to a low-pressure reservoir during the retardation or braking of the swing motion. By way of another example, a boom system may waste energy during lowering of arm components.

The energy loss in such hydro-mechanical machines is due to swift and short rotation cycle of 45° to 180°, where the rotation is stopped with high braking force. This results in conversion of kinetic energy into heat energy. Such loss of energy not only results in efficiency loss but also affect components due to heat dissipation.

There is therefore, need for a hydraulic system in a hydro-mechanical machine, which reuses such loss of energy and increases overall efficiency of the hydro-mechanical machine.

SUMMARY

In an embodiment, a hydraulic system for a hydro-mechanical machine comprising a rotary mechanism is disclosed. The hydraulic system includes a primary accumulator configured to receive and store high-pressure fluid in response to stopping of the rotary mechanism. The hydraulic system further includes a control system coupled to the primary accumulator through a hydraulic supply circuit, wherein the control system is configured to enable passage of the high-pressure fluid stored in the primary accumulator to a rotary mechanism control valve configured to control the rotary mechanism, through the hydraulic supply circuit, based on a predefined pressure threshold associated with the primary accumulator. The hydraulic system includes a secondary accumulator coupled to the primary accumulator and the control system via the hydraulic supply circuit, wherein the secondary accumulator is configured to store surplus high-pressure fluid provided by the primary accumulator through the hydraulic supply circuit.

In another embodiment, a hydraulic system for a hydro-mechanical machine comprising a rotary mechanism is disclosed. The hydraulic system includes a primary accumulator configured to receive high-pressure fluid in response to stopping of the rotary mechanism, temporarily store the high-pressure fluid, and provide the high-pressure fluid to a rotary mechanism control valve configured to control the rotary mechanism through a hydraulic supply circuit, based on a predefined pressure threshold associated with the primary accumulator. The hydraulic system further includes a secondary accumulator coupled to the primary accumulator via the hydraulic supply circuit. The secondary accumulator is configured to store surplus high-pressure fluid provided by the primary accumulator in the hydraulic supply circuit.

In yet another embodiment, a hydraulic system for an off-highway machine comprising a swing motor is disclosed. The hydraulic system includes a primary accumulator configured to receive and store high-pressure fluid in response to stopping of the swing motor. The hydraulic system further includes a control system coupled to the primary accumulator through a hydraulic supply circuit, wherein the control system is configured to enable passage of the high-pressure fluid stored in the primary accumulator to a rotary mechanism control valve configured to control the swing motor, through the hydraulic supply circuit, based on a predefined pressure threshold associated with the primary accumulator. The hydraulic system includes a secondary accumulator coupled to the primary accumulator and the control system via the hydraulic supply circuit, wherein the secondary accumulator is configured to store surplus high-pressure fluid provided by the primary accumulator through the hydraulic supply circuit.

It is to be understood that both the foregoing general description and the following detailed description are exemplary and explanatory only and are not restrictive of the invention, as claimed.

BRIEF DESCRIPTION OF THE DRAWINGS

The accompanying drawings, which are incorporated in and constitute a part of this disclosure, illustrate exemplary embodiments and, together with the description, serve to explain the disclosed principles.

DETAILED DESCRIPTION

Exemplary embodiments are described with reference to the accompanying drawings. Wherever convenient, the same reference numbers are used throughout the drawings to refer to the same or like parts. While examples and features of disclosed principles are described herein, modifications, adaptations, and other implementations are possible without departing from the spirit and scope of the disclosed embodiments. It is intended that the following detailed description be considered as exemplary only, with the true scope and spirit being indicated by the following claims.

Figure 1:
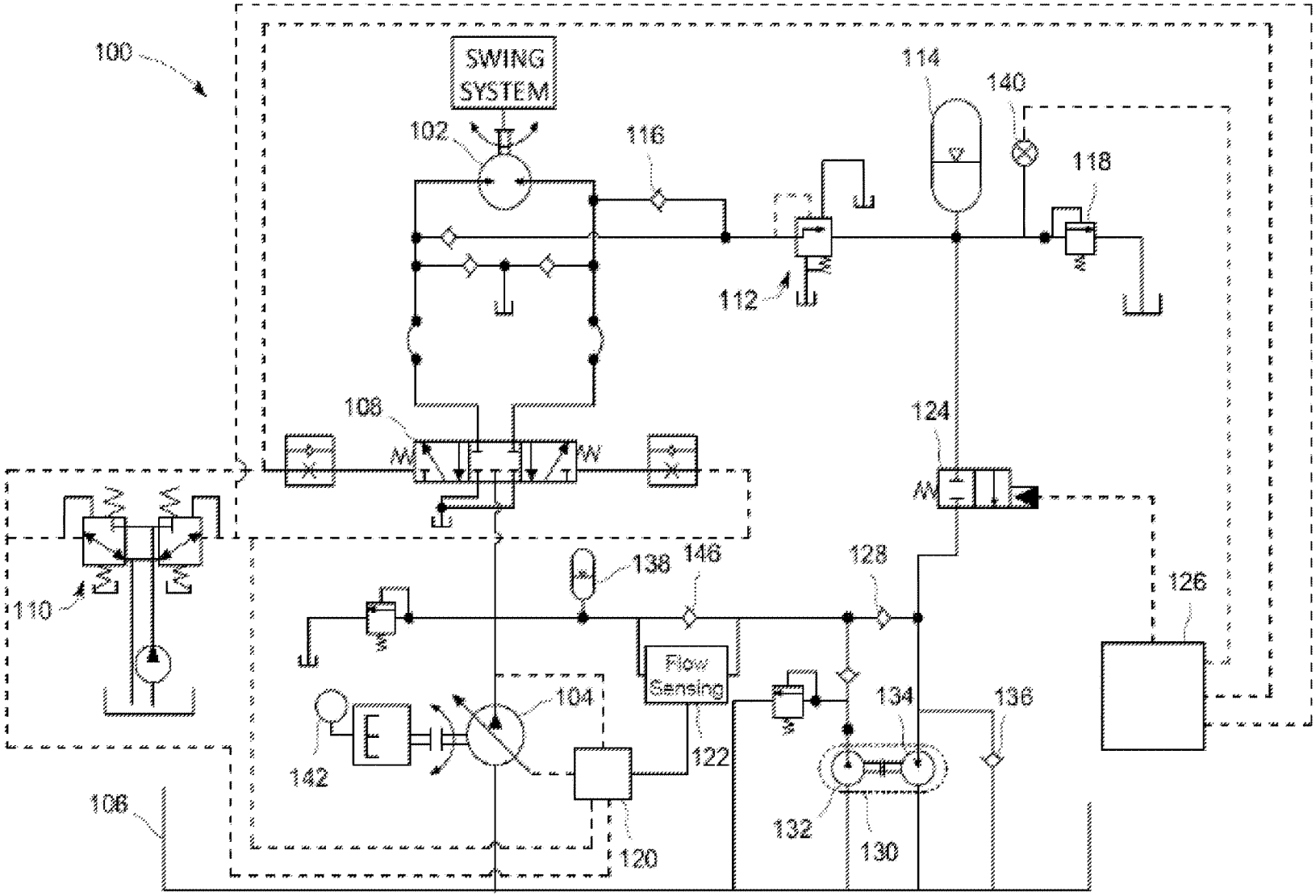
FIG. 1 illustrates a hydraulic supply circuit for a hydro-mechanical machine that includes a rotary mechanism and uses positive flow control or negative flow control pumps systems, in accordance with an embodiment.

Referring now to FIG. 1, a hydraulic supply circuit 100 for a hydro-mechanical machine (not shown in FIG. 1) that includes a rotary mechanism 102 and uses positive flow control or negative flow control pumps systems is illustrated, in accordance with an embodiment. The hydro-mechanical machine, for example, may be an off-highway machine, an Excavator, a truck mounted crane, a rough terrain crane, a slew crane, a knuckle boom crane, a crawler crane, a pipe layers, a boom lift, and an aerial work platform. The hydro-mechanical machine includes a primary pump system 104, which may be a variable displacement pump. Examples of the variable displacement pump may include, but are not limited to a load sensing type pump of open center or closed center type, a positive flow control pump, or a negative flow control pump, or any other type of variable displacement pump operating in open loop or closed loop hydraulic system or any other configuration in hydro-mechanical machines that include the rotary mechanisms 102. The hydraulic supply circuit 100 is limited to hydraulic arrangement for the primary pump system 104 in open loop circuit that uses positive flow control or negative flow control. It will be apparent to a person skilled in the art that additional embodiment may include, but are not limited to variable displacement pump fitted in any type of hydraulic circuit, in open loop or closed loop circuit configuration, fitted in hydro-mechanical machines that include rotary mechanisms.

The primary pump system 104 is connected to a fluid reservoir 106 that includes a fluid. Examples of the fluid, may include, but are not limited to oil or water. The fluid reservoir 106 is configured to supply the fluid to the rotary mechanism 102 through a rotary mechanism control valve 108, thereby enabling the rotary mechanism 102 to provide a rotary swing movement to a connected work tool. By way of an example, in an off-highway machine, the connected work tool may be an excavating boom, arm, bucket with associated mechanism and the rotary mechanism 102 may be a swing hydraulic motor or any other kind of rotary motor, for example, track motor or wheel hydraulic motor.

The rotary mechanism control valve 108 may be controlled by a swing controller 110. Examples of the swing controller 110 may include, but are not limited to a joystick, electronic controller, computer controller, a mobile device controller, or any other type of existing controller. An operator may engage or use the swing controller 110 to control functioning of the rotary mechanism 102. When the swing controller 110 is operated to rotate the rotary mechanism 102 in a desired direction, a pilot pressure is applied to the rotary mechanism control valve 108. The pilot pressure may vary between a predefined range, for example, but not limited to: 0 to 40 bars. In response to the pilot pressure, the passage of supply of the fluid in the rotary mechanism control valve 108 is opened and the fluid is supplied through the primary pump system 104 that in turn rotates the rotary mechanism 102 in a desired direction.

In an embodiment, the pilot pressure supplied to the rotary mechanism control valve 108 and the direction of supply of the fluid depends upon an angular movement of the swing controller 110. In response to receiving a start signal from the swing controller 110, the rotary mechanism control valve 108 may open the fluid supply from the primary pump system 104 to the rotary mechanism 102 in a desired direction. The rotary mechanism 102 in turn may rotate a required component (for example, a connected work tool) of the hydro-mechanical machine. Similarly, in response to receiving a stop signal from the swing controller 110, the rotary mechanism control valve 108 may close the fluid supply from the primary pump system 104 to the rotary mechanism 102.

However, the rotary mechanism 102 may keep on rotating due to inertia of the component of the hydro-mechanical machine. In other words, the rotary mechanism 102 may act as a pump and may enable pressure to build up on the downstream side of the rotary mechanism 102. The high-pressure build up on the downstream side of the rotary mechanism 102 may enable opening of a regenerative valve 112. It will be apparent to a person skilled in the art that the hydro-mechanical machine may include multiple regenerative valves 112. The regenerative valve 112 may divert high-pressure fluid received as a result of stopping of the rotary mechanism 102 to a primary accumulator 114. The primary accumulator 114 may store the high-pressure energy in the high-pressure fluid, which is received through the regenerative valve 112, in the form of hydraulic energy.

In an embodiment, the primary accumulator 114 may be pre-charged with an inert gas and may store the fluid at high pressure. Examples of the inert gas may include, but are not limited to nitrogen, or argon. Alternatively, the primary accumulator 114 may be a rubber bladder type accumulator or a piston type accumulator or diaphragm type or spring actuated mechanical type or any other similar type. Additionally, the hydraulic supply circuit 100 may include a check valve 116, which is configured to check the back flow of the fluid from the primary accumulator 114 to the rotary mechanism 102 (for example, a swing motor). In an embodiment, the primary accumulator 114 may also include an accumulator relief valve 118 that is configured to limit or control the maximum fluid pressure in the primary accumulator 114.

The hydraulic supply circuit 100 may further include a pump controller 120 that is configured to control the primary pump system 104. The pump controller 120 may vary the displacement of the primary pump system 104 based on actuation of the swing controller 110, flow required by the rotary mechanism 102, and available fluid supply from the primary accumulator 114.

According to an embodiment, the pump controller 120 may get a signal from one or more of the swing controller 110, sensing of pressure at outlet of the primary pump system 104, or a flow sensing arrangement 122 of fluid flow as measured in a supply line across a check valve 146, which gives indication of fluid supply from the primary accumulator 114 and the quantity of flow rate. Accordingly, the flow sensing arrangement 122 gives hydraulic oil supply feedback to the pump controller 120 and the primary pump system 104 in order to reduce displacement and thereby flow from the primary pump system 104 by an amount which is same as the amount of fluid flow supplied by the primary accumulator 114. The flow sensing arrangement 122 may be of differential pressure sensing arrangement or any other type of flow sensing arrangement.

The pump controller 120 may control the flow of the primary pump system 104, based on operation of the swing controller 110, in order to supply fluid to the rotary mechanism control valve 108 to rotate the rotary mechanism 102. Additionally, the pump controller 120 may control pressure at outlet of the primary pump system 104, decrease or increase of displacement and flow rate of the primary pump system 104, based on flow demand of the rotary mechanism 102 and fluid supply feedback received from the flow sensing arrangement 122, which indicates fluid flow rate from the primary accumulator 114.

The primary accumulator 114 may supply the stored fluid through a direction control valve 124. The control valve 124, for example, may include, but is not limited to a pilot hydraulic operated or solenoid operated or proportional type or any other type. The supply of the fluid from the primary accumulator 114 to the rotary mechanism control valve 108 may be initiated and controlled by a control system 126. The control system 126, for example, may include, but is not limited to pilot operated hydraulic controls that may work based on pressure actuation by sensing oil supply by the rotary mechanism control valve 108, a solenoid operated control, an electro-hydraulic control, or an electronic control unit or microprocessor based computer control.

In an embodiment, when the swing controller 110 is operated to rotate the rotary mechanism 102, the control valve 124 may be actuated and opens the supply of fluid from the primary accumulator 114 to the rotary mechanism control valve 108 and the rotary mechanism 102. The fluid may be supplied directly to the rotary mechanism control valve 108 by opening a check valve 128 and the check valve 146 in free flow direction and through a secondary pump system 130.

The secondary pump system 130 may include a hydraulic pump 132 that is mechanically driven by a hydraulic motor 134. The hydraulic motor 134 converts hydraulic energy of the fluid received from the primary accumulator 114 to mechanical energy. This mechanical energy may be used to run the hydraulic pump 132, which converts medium pressure energy of the fluid in the primary accumulator 114 to high pressure energy, which would be sufficient to feed to the rotary mechanism control valve 108. The hydraulic pump 132 may supply the fluid to the rotary mechanism control valve 108 in parallel to the primary pump system 104. In an embodiment, a check valve 136 may be provided in parallel to the supply line of the hydraulic motor 134. The check valve 136 may prevent cavitation of the hydraulic motor 134, when there is scarcity of fluid supply from the primary accumulator 114. In another embodiment, the hydraulic motor 134 may be connected to the primary pump system 104 to directly drive and thereby reduce demand of the power from an engine of the hydro-mechanical machine. In the secondary pump system 130, the hydraulic pump 132 and hydraulic motor 134 depicted in FIG. 1 are of fixed displacement type. However, it will be apparent to a person skilled in the art that the hydraulic pump 132 and hydraulic motor 134 may be of variable displacement type or any other variation thereof. This enables recovery of hydraulic power independent of variation in load pressure of the rotary mechanism 102 or supply pressure of the primary pump system 104.

In the hydraulic supply circuit 100, a secondary accumulator 138 may be provided in the line supplying fluid from the hydraulic pump 132 to the rotary mechanism control valve 108. The secondary accumulator 138 may be provided near a junction of the primary pump system 104 to reduce pressure fluctuations due to variation in demand of fluid flow by the rotary mechanism 102 and supply of fluid from the primary accumulator 114. In an embodiment, when the opening in the rotary mechanism control valve 108 is closed as a result of a stop command applied by the swing controller 110, and the secondary pump system 130 keeps on supplying the fluid due to inertia, the excess fluid is stored in the secondary accumulator 138. In a similar manner, during sudden or immediate start of the rotary mechanism 102 and opening of a supply port of the rotary mechanism control valve 108, when there is less oil supply available from the primary pump system 104 and the secondary pump system 130, the sudden demand flow may be supplied by the secondary accumulator 138.

The hydraulic supply circuit 100 may additionally include a pressure transducer or pressure gauge or pressure indicator 140 in communication with the primary accumulator 114 for measuring the pressure of the fluid in the primary accumulator 114. The pressure transducer 140 may be further configured to provide a feedback to the control system 126. According to an embodiment, the feedback may be in a form of an analog or a digital display. The control system 126 may also get feedback from the swing controller 110. Based on the feedback received from one or more of the pressure transducer 140 and the swing controller 110, the control system 126 may operate the control valve 124 to selectively supply fluid from the primary accumulator 114 directly to the rotary mechanism control valve 108 or through the secondary pump system 130.

As depicted in the hydraulic supply circuit 100, a fuel sensor 142 may also be provided in the fuel line of an engine of the hydro-mechanical machine. The fuel sensor 142 may have a digital display and may be used to measure and display the fuel consumed by the hydro-mechanical machine during various operations, which include rotary swing operation.

Figure 2:
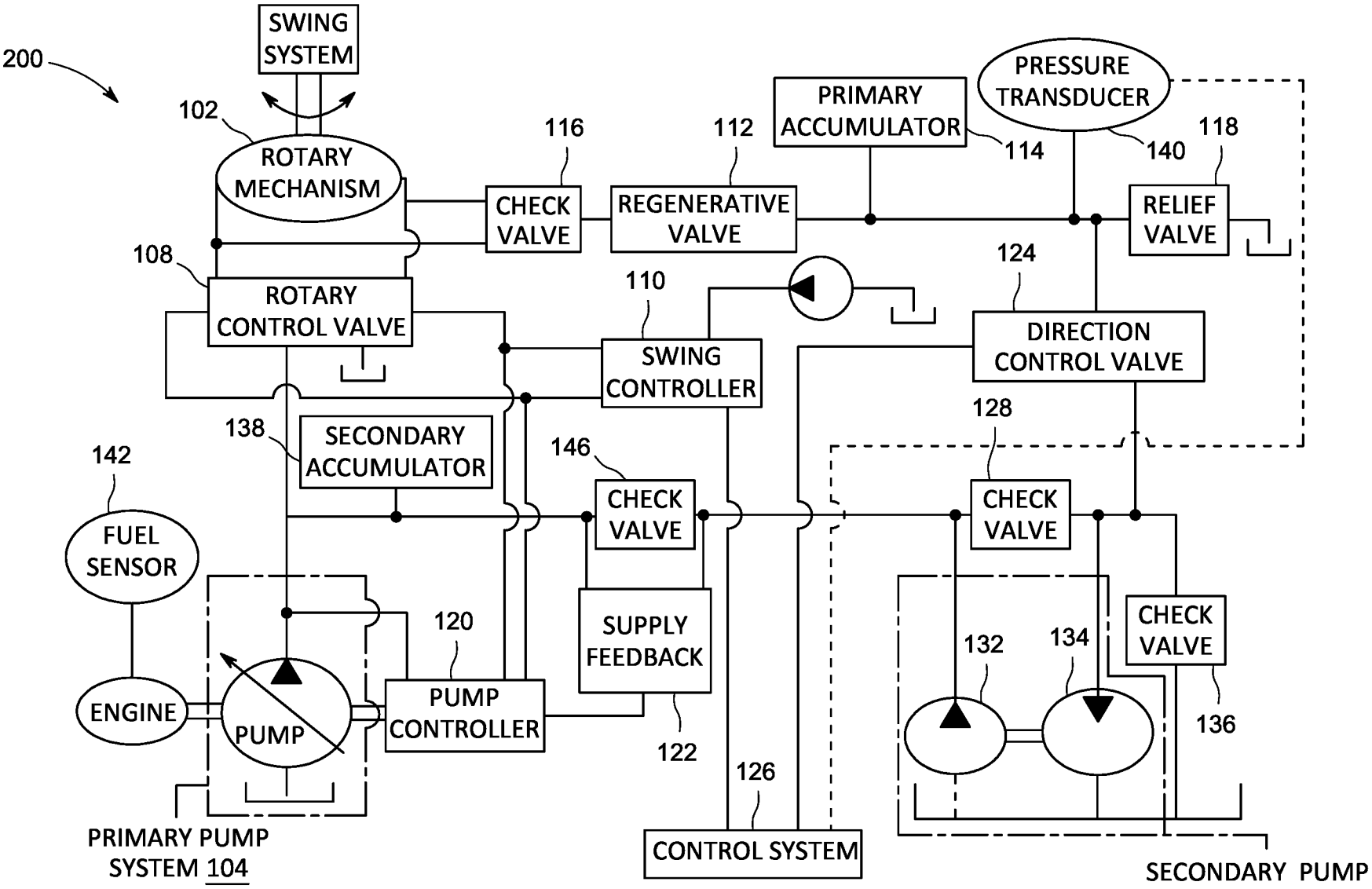
FIG. 2 illustrates a block diagram depicting various components in a hydraulic supply circuit for a hydro-mechanical machine that includes a rotary mechanism and uses positive flow control or negative flow control pumps systems, in accordance with an embodiment.

Various components in the hydraulic supply circuit 100 are also depicted by way of a block diagram 200 for the hydro-mechanical machine that includes the rotary mechanism 102 and uses positive flow control or negative flow control pumps systems as illustrated in FIG. 2, in accordance with an embodiment. The functionality of the components depicted in FIG. 2 is same as that described in FIG. 1.

Figure 3:
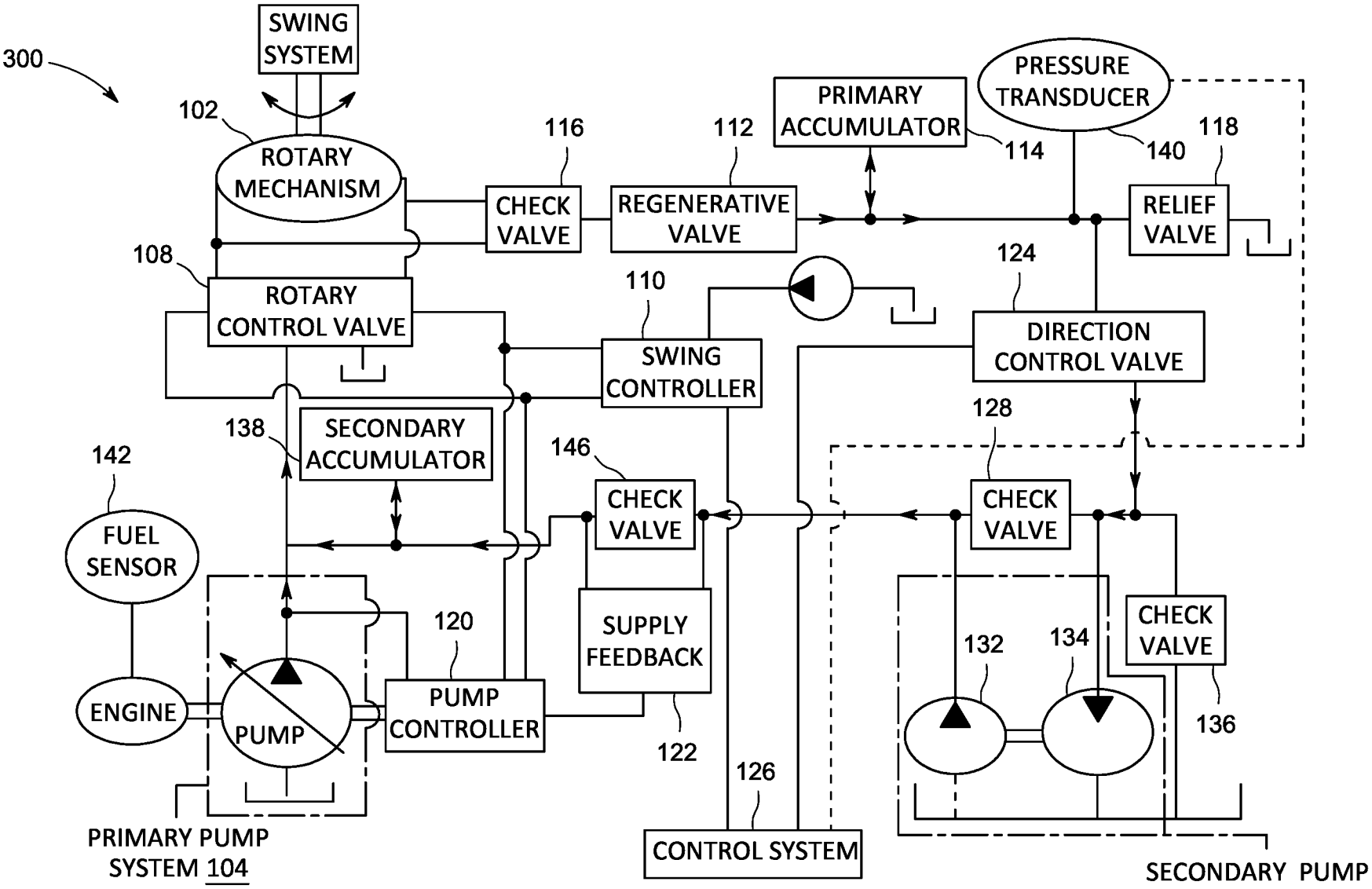
FIG. 3 illustrates a block diagram depicting fluid supply path for positive flow control or negative flow control pumps systems in hydro-mechanical machine, in accordance with an embodiment.

Referring now to FIG. 3, a block diagram 300 depicting fluid supply path for positive flow control or negative flow control pumps systems is illustrated, in accordance with an embodiment. In this embodiment, pressure in supply line of the rotary mechanism control valve 108 is less than pressure of the fluid in the primary accumulator 114. The fluid supply path is depicted by way of arrows, as illustrated in FIG. 3.

When the swing controller 110 sends a command to the rotary mechanism control valve 108 to rotate in clockwise or counter clockwise direction, the supply passage in the rotary mechanism control valve 108 is opened and the primary pump system 104 supplies fluid to the rotary mechanism control valve 108. This enables the rotary mechanism control valve 108 to rotate the rotary mechanism 102. When the swing controller 110 sends a stop command to the rotary mechanism control valve 108, the fluid passage in the rotary mechanism control valve 108 is closed. However, the rotary mechanism 102 keeps on rotating due to inertia, and thus acts as pump thereby supplying fluid under high pressure. The fluid, owing to the high pressure, opens the check valve 116 and the regenerative valve 112. Opening of these valves, enables the fluid under high pressure to enter the primary accumulator 114.

When the swing controller 110 applies rotation command and the primary accumulator 114 is sufficiently charged because of the fluid, the pressure of fluid in supply line of the rotary mechanism control valve 108 may be less than the pressure of fluid in the primary accumulator 114, by more than 5-7 bar. In this scenario, as the control valve 124 opens, the fluid is supplied by opening of the check valve 128 and the check valve 146 in a free flow direction. The fluid flow path from the primary accumulator 114 is indicated by arrows. The fluid is supplied by the primary accumulator 114 and pressure difference across the check valve 146 becomes positive. In other words, upstream pressure is more than downstream pressure across the check valve 146. In this scenario, the supply feedback from the flow sensing arrangement 122 is fed to the pump controller 120 in order to reduce displacement and thereby flow from the primary pump system 104 by an amount which is same as the amount of fluid flow supplied by the primary accumulator 114.

Figure 4:
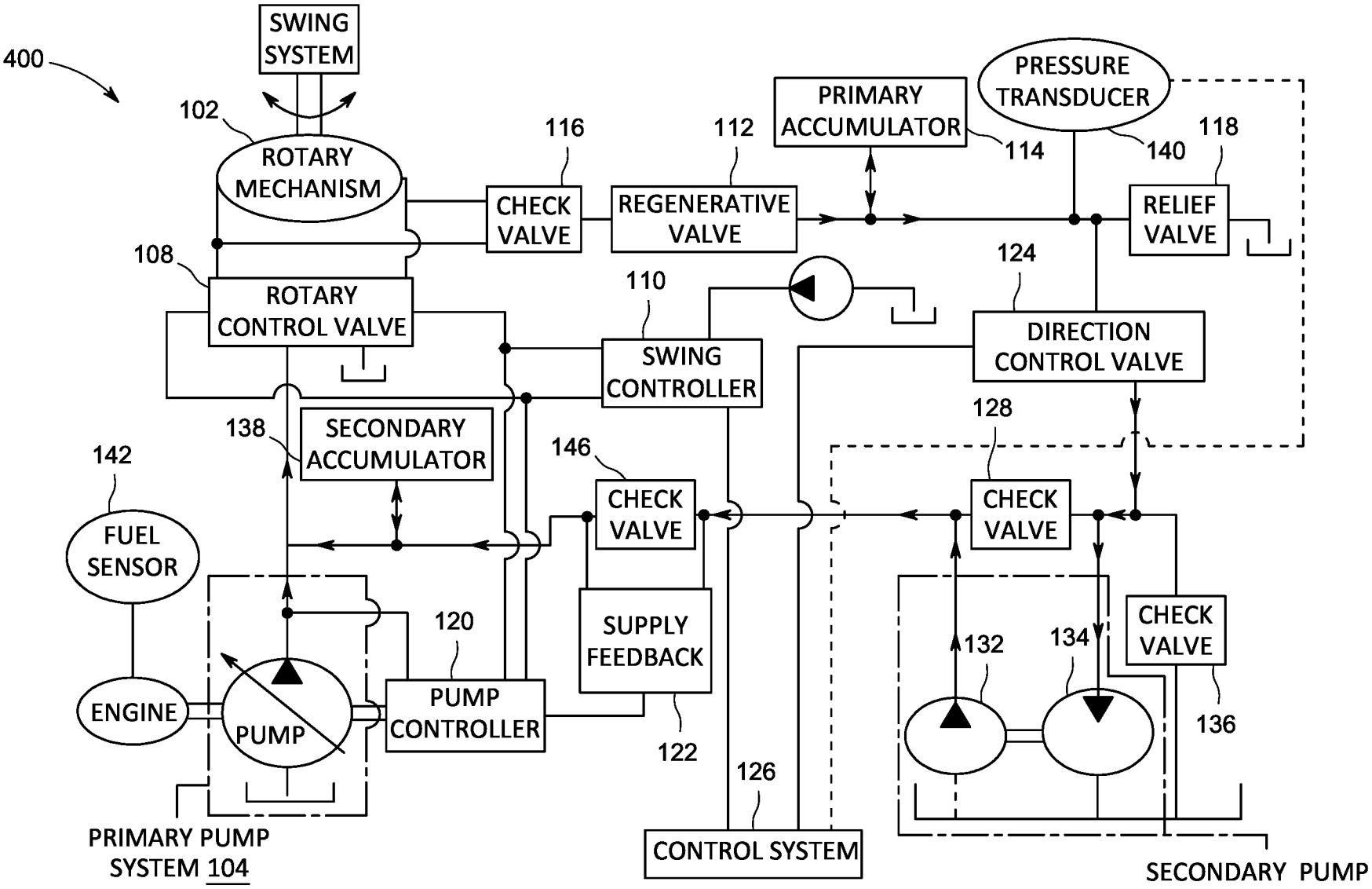
FIG. 4 illustrates a block diagram depicting fluid supply path for positive flow control or negative flow control pumps systems in hydro-mechanical machine, in accordance with another embodiment.

Referring now to FIG. 4, a block diagram 400 depicting fluid supply path for positive flow control or negative flow control pumps systems is illustrated, in accordance with another embodiment. In this embodiment, the pressure in supply line of the rotary mechanism control valve 108 is equal or more than pressure of the fluid oil in the primary accumulator 114.

The fluid flow path is depicted using arrows, as illustrated in FIG. 4. The swing controller 110 may apply rotation command to the rotary mechanism control valve 108 and the primary accumulator 114 may be moderately charged. Additionally, the pressure of the fluid in the supply line of the rotary mechanism control valve 108 may be equal to or more than the pressure of the fluid in the primary accumulator 114. In this scenario, the control valve 124 opens, however, the fluid is not able to flow by opening of the check valve 128 in free flow direction, owing to less pressure of the fluid. Thus, in such a case, fluid is supplied to the hydraulic motor 134, which converts medium pressure hydraulic energy of the fluid into mechanical energy and drives the hydraulic pump 132 coupled to the hydraulic motor 134. The displacement of the hydraulic pump 132 may be less than the displacement of the hydraulic motor 134 in accordance with a predefined proportion. Conformance with the predefined proportion increases pressure of oil supplied by the hydraulic pump 132, so that the pressure is sufficient enough to feed to the rotary mechanism control valve 108. The hydraulic pump 132 converts the mechanical energy into high pressure of the fluid that opens the check valve 146 and supplies fluid to the rotary mechanism control valve 108. The hydraulic motor 134 and the hydraulic pump 132 may be fixed displacement type or variable displacement type. The displacement of the hydraulic pump 132 may be less than displacement of the hydraulic motor 134 in a predefined proportion. This enables increase of pressure of fluid supplied by the hydraulic pump 132, such that, the pressure is sufficient to feed the fluid to the rotary mechanism control valve 108.

Thus, the secondary pump system 130, which is the combination of the hydraulic motor 134 and the hydraulic pump 132, converts medium pressure energy of the fluid received from the primary accumulator 114 to high pressure energy of the fluid, in order to supply fluid to the rotary mechanism control valve 108 in parallel to the primary pump system 104. The fluid flow path from the primary accumulator 114 is depicted by way of arrows. As the fluid is supplied by the secondary pump system 130, the difference of pressure across the check valve 146 may become positive. In other words, upstream fluid pressure is more than downstream fluid pressure across the check valve 146. In this case, the flow sensing arrangement 122 feeds the supply feedback to the pump controller 120. In response, the pump controller 120 reduces displacement and thereby flow rate from the primary pump system 104 by an amount which is same as the amount of fluid flow supplied by the primary accumulator 114.

Figure 5:
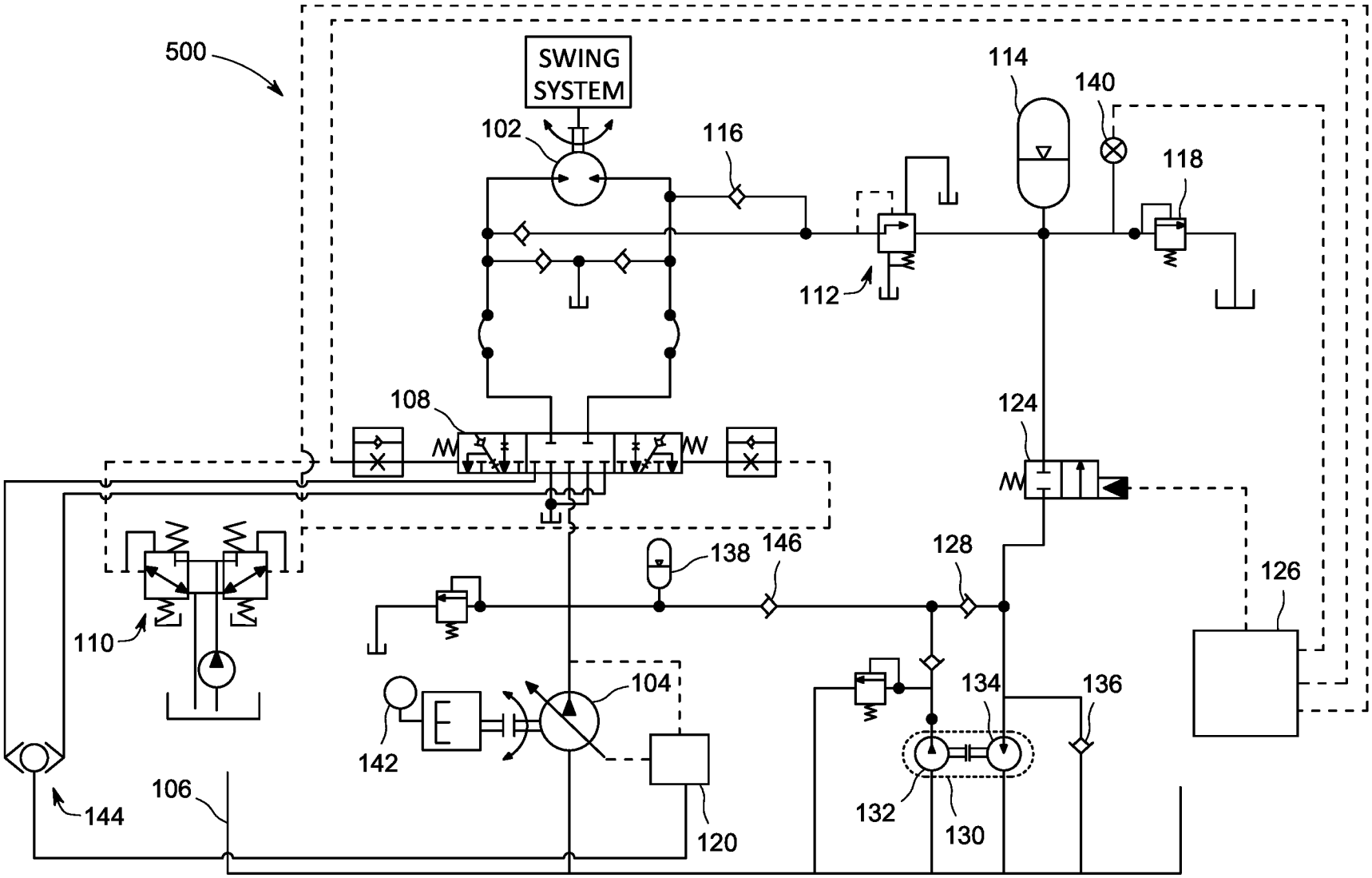
FIG. 5 illustrates a hydraulic supply circuit for a hydro-mechanical machine that includes a rotary mechanism and uses load sensing variable displacement pump systems, in accordance with an embodiment.

Referring now to FIG. 5, a hydraulic supply circuit 500 for a hydro-mechanical machine (not shown in FIG. 5) that includes the rotary mechanism 102 and uses load sensing variable displacement pump systems is illustrated, in accordance with an embodiment. In the hydraulic supply circuit 500, the pump controller 120 controls displacement of the primary pump system 104. The pump controller 120 thus also controls flow rate of the primary pump system 104 by sensing pressure at outlet of a pump in the primary pump system 104 and load pressures as sensed through a shuttle valve 144 from outlet of the rotary mechanism control valve 108.

When the primary accumulator 114 is adequately charged with hydraulic fluid pressure and the swing controller 110 is operated to open fluid supply path of the rotary mechanism control valve 108 to rotate the rotary mechanism 102, the fluid is supplied from the primary accumulator 114 by opening the control valve 124 to the rotary mechanism control valve 108 in order to rotate the rotary mechanism 102. The fluid is supplied parallel to the primary pump system 104. The pump controller 120 continuously senses pressure at outlet of a pump in the primary pump system 104 and load pressures as sensed by the shuttle valve 144. The pump controller 120 maintains constant pressure drop across the rotary mechanism control valve 108.

When the primary accumulator 114 supplies additional flow to the rotary mechanism control valve 108 and the pressure drop across the rotary mechanism control valve 108 increases more than set pressure due to excess flow, the pump controller 120 automatically reduces displacement and thereby flow rate of the primary pump system 104 in order to maintain constant pressure drop across the rotary mechanism control valve 108. When fluid is supplied by the primary pump system 104 and the pressure drop across the rotary mechanism control valve 108 decreases below a predefined value, the pump controller 120 automatically increases displacement of the primary pump system 104, thereby increasing the associated flow rate.

Figure 6:
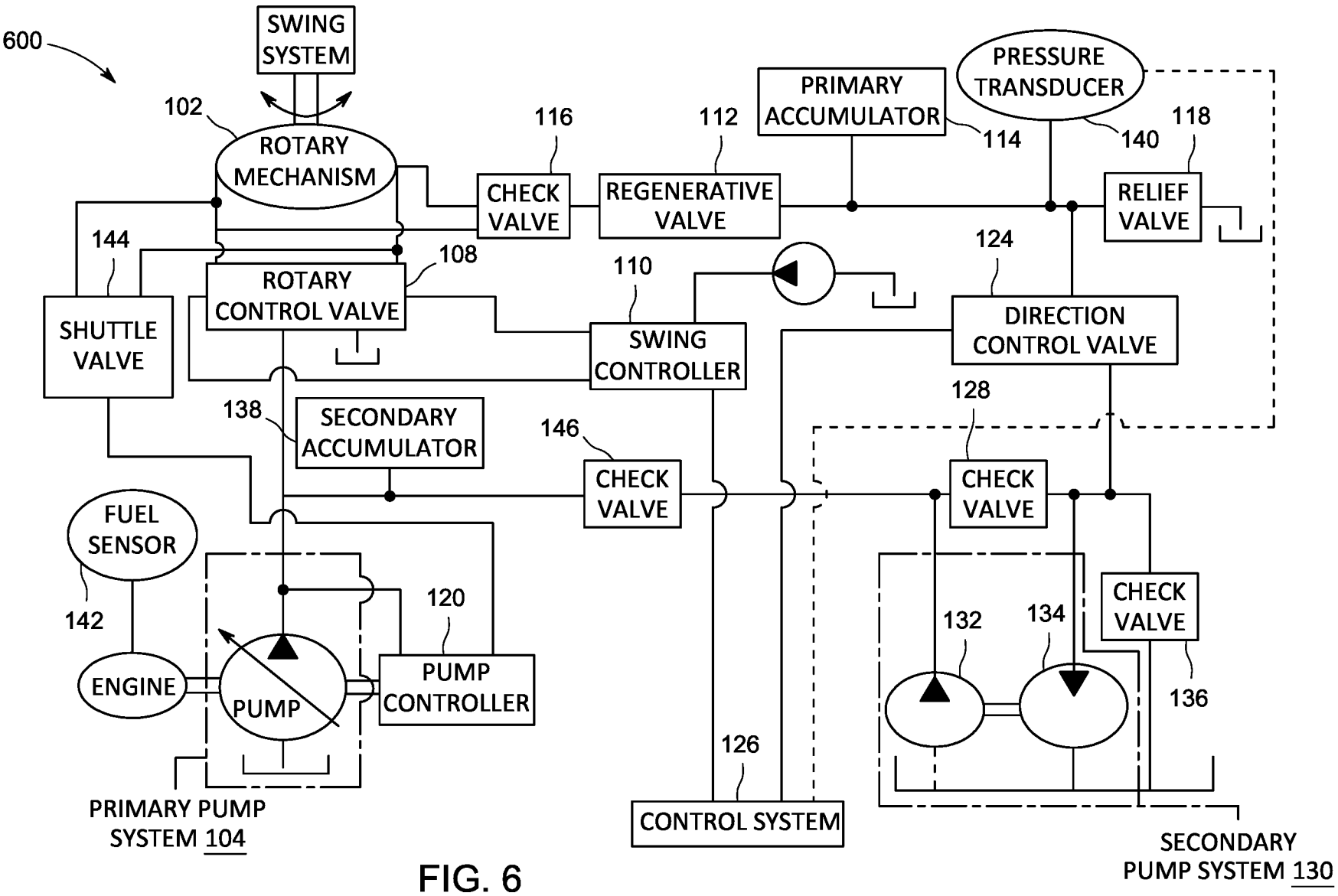
FIG. 6 illustrates a block diagram depicting various components in a hydraulic supply circuit for a hydro-mechanical machine that includes a rotary mechanism and uses load sensing variable displacement pumps systems, in accordance with an embodiment.

Various components in the hydraulic supply circuit 500 are also depicted by way of a block diagram 600 for the hydro-mechanical machine that includes the rotary mechanism 102 and uses load sensing variable displacement pumps systems, as illustrated in FIG. 6, in accordance with an embodiment. The functionality of the components depicted in FIG. 6 is same as that described in FIG. 5.

Various embodiments provide a hydraulic system for hydro-mechanical machines comprising rotary mechanism. The hydraulic system recovers energy from a rotary mechanism of a hydro-mechanical machine. The hydraulic system includes a primary pump system to supply a fluid from a fluid reservoir to the rotary mechanism through a rotary mechanism control valve. The hydraulic system further includes a primary accumulator, a control system, and a pump controller. The primary accumulator receives and selectively stores a high-pressure fluid from the rotary mechanism during de-acceleration. The control system controls the supply of fluid from the primary accumulator to the rotary mechanism control valve through a hydraulic supply circuit. The hydraulic system is such that, when the swing controller is operated to rotate the rotary mechanism, the hydraulic supply circuit enables passage of the high-pressure fluid from the primary accumulator directly to the rotary mechanism control valve through a control valve when the pressure in a fluid supply line of the rotary mechanism control valve is less than the pressure of the fluid in the primary accumulator. However, the hydraulic supply circuit enables passage of the high-pressure fluid from the primary accumulator to the rotary mechanism control valve through a secondary pump system, when the pressure in a fluid supply line of the rotary mechanism control valve is equal to or more than the pressure of the fluid in the primary accumulator. The primary accumulator supplies hydraulic fluid parallel to primary pump and the pump controller controls the output of the primary pump system based on fluid flow supply to the rotary mechanism control valve from the primary accumulator.

Thus, the hydraulic system recovers the energy, which is wasted during stopping of a rotary mechanism in a hydro-mechanical machine, by converting the energy into hydraulic potential energy. This energy is then reused to improve productivity and fuel efficiency of the hydro-mechanical machine. One or more accumulators in the hydraulic system collect kinetic energy caused by the motion of the rotary mechanism in the form of hydraulic energy. The one or more accumulators store the pressurized fluid draining from the rotary mechanism, which may be used later by the rotary mechanism. It will be apparent to a person skilled in the art that the hydraulic system may be applicable to any type of rotating bodies or machines where kinetic energy is lost while de-accelerating/stopping.

In the drawings and specification there has been set forth preferred embodiments of the invention, and although specific terms are employed, these are used in a generic and descriptive sense only and not for purposes of limitation. Changes in the form and the proportion of parts, as well as in the substitution of equivalents, are contemplated as circumstances may suggest or render expedient without departing from the spirit or scope of the invention.

The illustrated steps are set out to explain the exemplary embodiments shown, and it should be anticipated that ongoing technological development will change the manner in which particular functions are performed. These examples are presented herein for purposes of illustration, and not limitation. Alternatives (including equivalents, extensions, variations, deviations, etc., of those described herein) will be apparent to persons skilled in the relevant art(s) based on the teachings contained herein. Such alternatives fall within the scope and spirit of the disclosed embodiments.

It is intended that the disclosure and examples be considered as exemplary only, with a true scope and spirit of disclosed embodiments being indicated by the following claims.

What is claimed is:

1. A hydraulic system for a hydro-mechanical machine comprising a rotary mechanism, the hydraulic system comprising:

a primary accumulator configured to receive and store high-pressure fluid in response to stopping of the rotary mechanism;

a first control valve configured to control the rotary mechanism;

a line coupling the primary accumulator to the first control valve via a check valve and a second control valve that operates based on a predefined pressure threshold associated with the primary accumulator; and a secondary accumulator coupled to the line downstream from the second control valve.

2. The hydraulic system of claim 1, further comprising a control system configured to control operation of the second control valve to enable passage of the high-pressure fluid from the primary accumulator to the first control valve and the rotary mechanism via the line.

3. The hydraulic system of claim 2, wherein the control system is further configured to enable passage of the high-pressure fluid from the primary accumulator to the first control valve through the second control valve and the check valve when pressure in the line is less than the pressure of the high-pressure fluid in the primary accumulator.

4. The hydraulic system of claim 1, wherein the secondary accumulator is configured to:

store excess high-pressure fluid supplied by the primary accumulator; and supply the excess high-pressure fluid to the first control valve and the rotary mechanism.

5. The hydraulic system of claim 1, further comprising a pump controller configured to:

adapt output of a primary pump system coupled to the first control valve based on supply of the high-pressure fluid from the primary accumulator, wherein the output of the primary pump system includes fluid retrieved from a fluid reservoir; and vary displacement of the primary pump system based on at least one of: actuation of a swing controller, sensing of outlet pressure of the primary pump system, and fluid flow required by the rotary mechanism.

6. The hydraulic system of claim 1, further comprising a flow sensing arrangement in the line coupling the primary accumulator to the first control valve, wherein the flow sensing arrangement provides oil supply feedback to a primary pump system in order to reduce displacement and flow from the primary pump system as compared to an amount pumped by the primary pump system without fluid supplied by the primary accumulator.

7. The hydraulic system of claim 1, further comprising a secondary pump system coupled to the line, the secondary pump system configured to enable fluid flow to the first control valve when pressure in a fluid supply line of the first control valve is greater than or equal to the pressure of the high-pressure fluid in the primary accumulator.

8. The hydraulic system of claim 7, wherein the secondary pump system comprises:

a hydraulic motor configured to convert medium pressure hydraulic energy of the high-pressure fluid from the primary accumulator into mechanical energy; and a hydraulic pump coupled to the hydraulic motor, wherein the hydraulic motor drives the hydraulic pump.

9. The hydraulic system of claim 1, further comprising a pressure transducer configured to measure pressure in the primary accumulator.

10. A hydraulic system for a hydro-mechanical machine comprising a rotary mechanism, the hydraulic system comprising:

a primary accumulator configured to:

receive high-pressure fluid in response to stopping of the rotary mechanism;

temporarily store the high-pressure fluid; and provide the high-pressure fluid to a first control valve configured to control the rotary mechanism through a line via a second control valve and a check valve, based on a predefined pressure threshold associated with the primary accumulator; and a secondary accumulator coupled to the line downstream from the second control valve.

11. The hydraulic system of claim 10, wherein the secondary accumulator is configured to:

store excess high-pressure fluid supplied by the primary accumulator; and supply the excess high-pressure fluid to the first control valve and the rotary mechanism.

12. A hydraulic system for an off-highway machine comprising a swing motor, the hydraulic system comprising:

a primary accumulator configured to receive and store high-pressure fluid in response to stopping of the swing motor;

a first control valve configured to control the swing motor;

a line coupling the primary accumulator to the first control valve via a check valve and a second control valve that operates based on a predefined pressure threshold associated with the primary accumulator; and a secondary accumulator coupled to the line downstream from the second control valve.

13. The hydraulic system for an off-highway machine of claim 12, further comprising a control system configured to control operation of the second control valve to enable passage of the high-pressure fluid from the primary accumulator to the first control valve and the swing motor via the line.

14. The hydraulic system for an off-highway machine of claim 13, wherein the control system is further configured to enable passage of the high-pressure fluid from the primary accumulator to the first control valve through the second control valve and the check valve when pressure in the line is less than the pressure of the high-pressure fluid in the primary accumulator.

15. The hydraulic system for an off-highway machine of claim 12, wherein the secondary accumulator is further configured to:

store excess high-pressure fluid supplied by the primary accumulator; and supply the excess high-pressure fluid to the first control valve and the swing motor.

16. The hydraulic system for an off-highway machine of claim 12, further comprising a pump controller configured to:

adapt output of a primary pump system coupled to the first control valve based on supply of the high-pressure fluid from the primary accumulator, wherein the output of the primary pump system includes fluid retrieved from a fluid reservoir; and vary displacement of the primary pump system based on at least one of: actuation of a swing controller, sensing of outlet pressure of the primary pump system, and fluid flow required by the swing motor.

17. The hydraulic system for an off-highway machine of claim 12, further comprising:

a flow sensing arrangement in the line coupling the primary accumulator to the first control valve, wherein the flow sensing arrangement provides oil supply feedback to a primary pump system in order to reduce displacement and flow from the primary pump system as compared to an amount pumped by the primary pump system without fluid supplied by the primary accumulator.

18. The hydraulic system for an off-highway machine of claim 12, further comprising a secondary pump system coupled to the line, the secondary pump system configured to enable fluid flow to the first control valve when pressure in a fluid supply line of the first control valve is greater than or equal to the pressure of the high-pressure fluid in the primary accumulator.

19. The hydraulic system of claim 18, wherein the secondary pump system comprises:

a hydraulic motor configured to convert medium pressure hydraulic energy of the high-pressure fluid from the primary accumulator into mechanical energy; and a hydraulic pump coupled to the hydraulic motor, wherein the hydraulic motor drives the hydraulic pump.

20. The hydraulic system for an off-highway machine of claim 12, further comprising a pressure transducer configured to measure pressure in the primary accumulator.

* * * * *